US012331482B2

(12) United States Patent
Zimmerman

(10) Patent No.: US 12,331,482 B2
(45) Date of Patent: Jun. 17, 2025

(54) LOAD-DEPENDENT MACHINE AGGRESSIVENESS FOR A WORK VEHICLE AND RELATED SYSTEMS AND METHODS

(71) Applicant: CNH Industrial America LLC, New Holland, PA (US)

(72) Inventor: Joshua D. Zimmerman, Plainfield, IL (US)

(73) Assignee: CNH Industrial America LLC, New Holland, PA (US)

( * ) Notice: Subject to any disclaimer, the term of this patent is extended or adjusted under 35 U.S.C. 154(b) by 179 days.

(21) Appl. No.: 18/112,664

(22) Filed: Feb. 22, 2023

(65) Prior Publication Data

US 2024/0279905 A1 Aug. 22, 2024

(51) Int. Cl.
*E02F 9/20* (2006.01)
*E02F 9/22* (2006.01)

(52) U.S. Cl.
CPC ..... *E02F 9/2029* (2013.01); *E02F 9/2037* (2013.01); *E02F 9/2228* (2013.01); *E02F 9/225* (2013.01); *E02F 9/2296* (2013.01)

(58) Field of Classification Search
CPC ..... E02F 9/2029; E02F 9/2037; E02F 9/265
See application file for complete search history.

(56) References Cited

U.S. PATENT DOCUMENTS 5,941,921 A * 8/1999 Dasys ..... E02F 3/434 701/50
6,086,509 A * 7/2000 Johnson ..... E02F 9/2253 477/900
2020/0063399 A1* 2/2020 Miller ..... E02F 9/265
2020/0308803 A1* 10/2020 Singh ..... E02F 3/434
2021/0246626 A1* 8/2021 Yamamoto ..... G08B 21/24
2022/0135036 A1* 5/2022 Dongare ..... E02F 3/437 701/70
2022/0403622 A1* 12/2022 Abd El Salam Mohamed ..... E02F 9/265
2023/0095687 A1* 3/2023 Nakamoto ..... E02F 9/265 414/699

* cited by examiner

*Primary Examiner* — Long T Tran
(74) *Attorney, Agent, or Firm* — Rickard K. DeMille; Rebecca L. Henkel; Peter K. Zacharias

(57) ABSTRACT

A method for implementing load-dependent machine aggressiveness for vehicle functions of a work vehicle includes receiving, with one or more computing devices, load-related data associated with a load weight for an implement of a work vehicle, the implement being coupled to a boom of the work vehicle, and receiving, with the one or more computing devices, an operator-initiated input command associated with executing a vehicle function of the work vehicle. The method also includes determining, with the one or more computing devices, an output command for controlling the operation of at least one component of the work vehicle based at least in part on the load-related data and the input command, and controlling, with the one or more computing devices, the operation of the least one component based at least in part on the output command to execute the vehicle function.

21 Claims, 5 Drawing Sheets

LOAD-DEPENDENT MACHINE AGGRESSIVENESS FOR A WORK VEHICLE AND RELATED SYSTEMS AND METHODS

FIELD OF THE INVENTION

The present subject matter relates generally to work vehicles and, more particularly, systems and methods for providing load-dependent machine aggressiveness for vehicle functions of a work vehicle.

BACKGROUND OF THE INVENTION

Work vehicles having loader arms or booms, such as wheel loaders, skid steer loaders, and the like, are a mainstay of construction work and industry. For example, wheel loaders typically include a boom pivotally coupled to the vehicle's chassis that can be raised and lowered at the operator's command. The boom typically has an implement attached to its end, thereby allowing the implement to be moved relative to the ground as the boom is raised and lowered. For example, a bucket is often coupled to the boom, which allows the wheel loader to be used to carry supplies or particulate matter, such as gravel, sand, or dirt, around a worksite or to transfer such supplies or matter to an adjacent transport vehicle (e.g., a truck or railroad car).

Conventionally, vehicle controls for work vehicles including a boom or loader arm have been tuned for a single machine setting associated with high productivity, thereby allowing for very responsive motions of the vehicle's actuators to input control commands received from the operator. However, when the lift assembly is substantially loaded, certain functions of the work vehicle can become even more responsive than anticipated due to the heavy load. For novice or inexperienced operators, this may result in the work vehicle responding much faster than anticipated, which can lead to the operator losing control of the work vehicle (including dropping the load carried by the lift assembly).

Accordingly, systems and methods that allow for load-dependent machine aggressiveness to account for different loads being carried by a lift assembly of a work vehicle would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for implementing load-dependent machine aggressiveness for vehicle functions of a work vehicle. The method includes receiving, with one or more computing devices, load-related data associated with a load weight for an implement of a work vehicle, the implement being coupled to a boom of the work vehicle, and receiving, with the one or more computing devices, an operator-initiated input command associated with executing a vehicle function of the work vehicle. The method also includes determining, with the one or more computing devices, an output command for controlling the operation of at least one component of the work vehicle based at least in part on the load-related data and the input command, and controlling, with the one or more computing devices, the operation of the least one component based at least in part on the output command to execute the vehicle function.

In another aspect, the present subject matter is directed to a system for implementing load-dependent machine aggressiveness for vehicle functions of a work vehicle. The system includes a lift assembly including a boom and an implement coupled to the boom. The system also includes at least one sensor configured to generate load-related data associated with a load weight for the implement, and a controller communicatively coupled to the at least one sensor. The controller includes a processor and associated memory. The memory stores instructions, that when implemented by the processor, configure the controller to receive the load-related data from the at least one sensor, receive an operator-initiated input command associated with executing a vehicle function of the work vehicle, determine an output command for controlling the operation of at least one component of the work vehicle based at least in part on the load-related data and the input command, and control the operation of the least one component based at least in part on the output command to execute the vehicle function.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
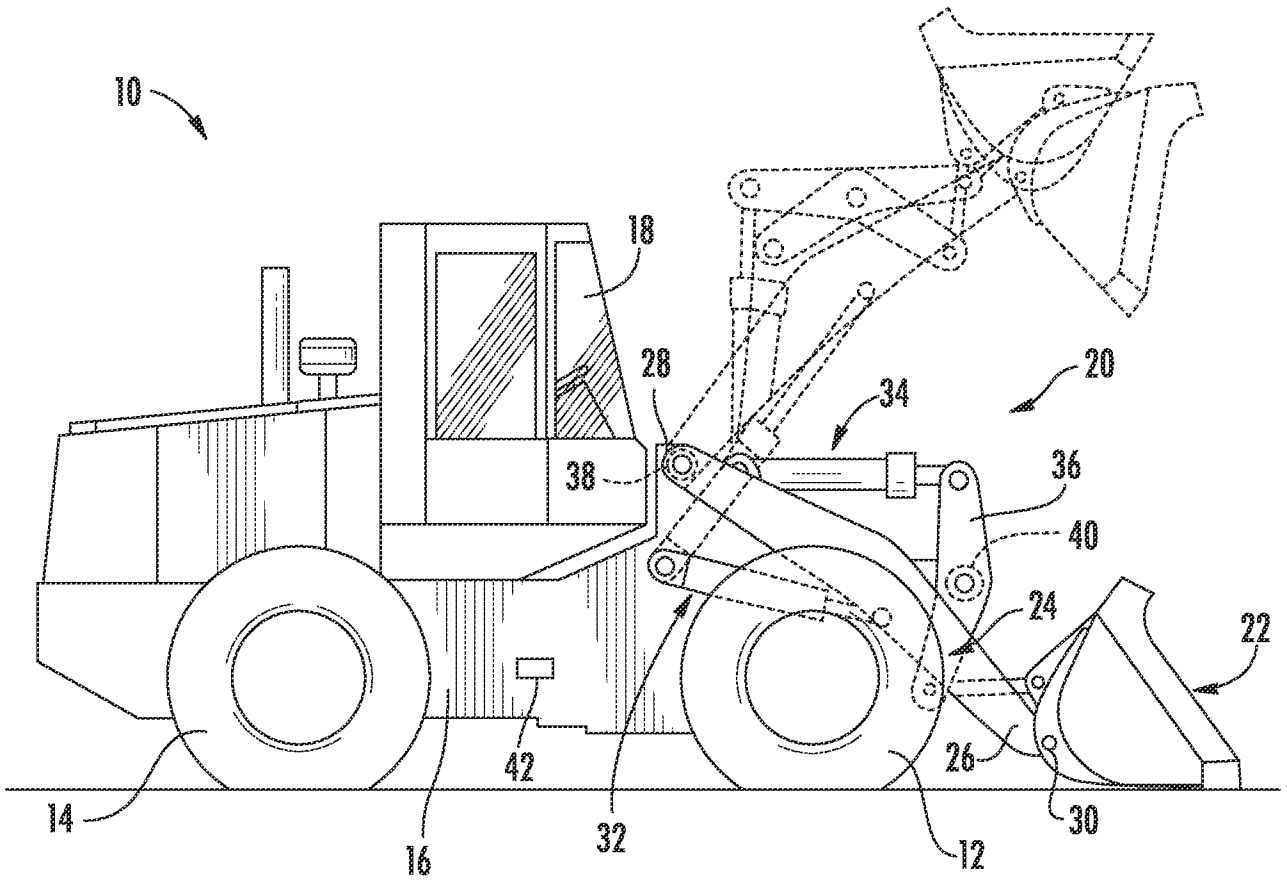
FIG. 1 illustrates a side view of one embodiment of a work vehicle in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for implementing load-dependent machine aggressiveness for vehicle functions of a work vehicle. Specifically, as will be described below, the disclosed systems and methods may allow for a load-dependent input/output control mapping to be applied that adjusts the sensitivity or responsiveness (i.e., the aggressiveness) of the control of one or more vehicle components to operator-initiated input commands as a function of the load weight being carried by an implement of the work vehicle. For instance, the input/output control mapping may be adapted to reduce the sensitivity or responsiveness of component control as implement load weights increase, thereby reducing the likelihood that the operator loses control of the vehicle (or loses control of one or more related vehicle functions).

Referring now to the drawings, FIG. 1 illustrates a side view of one embodiment of a work vehicle 10 in accordance with aspects of the present subject matter. As shown, the work vehicle 10 is configured as a wheel loader. However, in other embodiments, the work vehicle 10 may be configured as any other suitable work vehicle that includes a lift assembly for adjusting the position of an associated implement, such as a skid steer loader, a backhoe loader, a compact track loader and/or the like.

As shown, the work vehicle 10 includes a pair of front wheels 12, (one of which is shown), a pair of rear wheels 14 (one of which is shown) and a frame or chassis 16 coupled to and supported by the wheels 12, 14. An operator's cab 18 may be supported by a portion of the chassis 16 and may house various input devices for permitting an operator to control the operation of the work vehicle 10.

Moreover, as shown in FIG. 1, the work vehicle 10 may include a lift assembly 20 for raising and lowering a suitable implement 22 (e.g., a bucket) relative to a driving surface of the vehicle 10. In several embodiments, the lift assembly 20 may include a boom 24 (e.g., including one or more loader or boom arms) pivotally coupled between the chassis 16 and the implement 22. For example, as shown in FIG. 1, the boom 24 may include a forward end 26 and an aft end 28, with the forward end 26 being pivotally coupled to the implement 22 at a forward pivot point 30 and the aft end 28 being pivotally coupled to a portion of the chassis 16.

In addition, the lift assembly 20 may also include one or more boom actuators 32 (e.g., electro-hydraulic cylinders) coupled between the chassis 16 and the boom 24 and one or more tilt actuators 34 (e.g., electro-hydraulic cylinders) coupled between the chassis 16 and the implement 22 (e.g., via a pivotally mounted bellcrank 36 or other mechanical linkage). It should be readily understood by those of ordinary skill in the art that the boom and tilt actuators 32, 34 may be utilized to allow the implement 22 to be raised/lowered and/or pivoted relative to the driving surface of the work vehicle 10. The boom actuator(s) 32 may be extended and retracted in order to pivot the boom 24 upward and downwards, respectively, thereby at least partially controlling the vertical positioning of the implement 22 relative to the driving surface. For instance, as shown in FIG. 1, the operation of the boom actuator(s) 32 may be controlled to move the boom 24 between a lowered position (indicated in solid lines), such as a return-to-dig-position or a return-to-travel position, and a raised position (indicated in dashed lines, such as a return-to-height position or a return-to-dump position. Additionally, the tilt actuator(s) 34 may be extended and retracted in order to pivot the implement 22 relative to the boom 24 about the forward pivot point 30, thereby controlling the tilt angle or orientation of the implement 22 relative to the driving surface.

The work vehicle 10 may also include a plurality of sensors for monitoring for various operating parameters of the work vehicle 10. For instance, as shown in FIG. 1, the work vehicle 10 may include one or more position sensors 38, 40 for monitoring the position and/or orientation of the boom 24 and/or the implement 22, such as by including a first position sensor 38 provided in operative association with the boom 24 (e.g., at or adjacent to the aft end 28 of the boom 24) and a second position sensor 40 provided in operative association with the bellcrank 36 (e.g., at or adjacent to a pivot point for the bellcrank 36). The position sensors 38, 40 may also allow the velocity of the boom 24 and/or the implement 22 to be determined by identifying the change in position of such component(s) over time. Additionally, as shown, the work vehicle 10 may include one or more inclination sensors 42 configured to monitor the angle of inclination of the work vehicle 10, such as by including a dual-axis inclination sensor 42 mounted to the chassis 16 that is configured to monitor the angle of inclination of the work vehicle 10 in both a pitch direction (e.g., the front-to-back inclination) and a roll direction (e.g., the side-to-side inclination). Moreover, as will be described below with reference to FIG. 2, the work vehicle 10 may also include one or more pressure sensors 44, 46 (FIG. 2) for monitoring the pressure of the hydraulic fluid supplied to the boom actuator(s) 32 and/or the tilt actuator(s) 34 and/or one or more temperature sensors 48 (FIG. 2) for monitoring the fluid temperature of the hydraulic fluid.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration.

Figure 2:
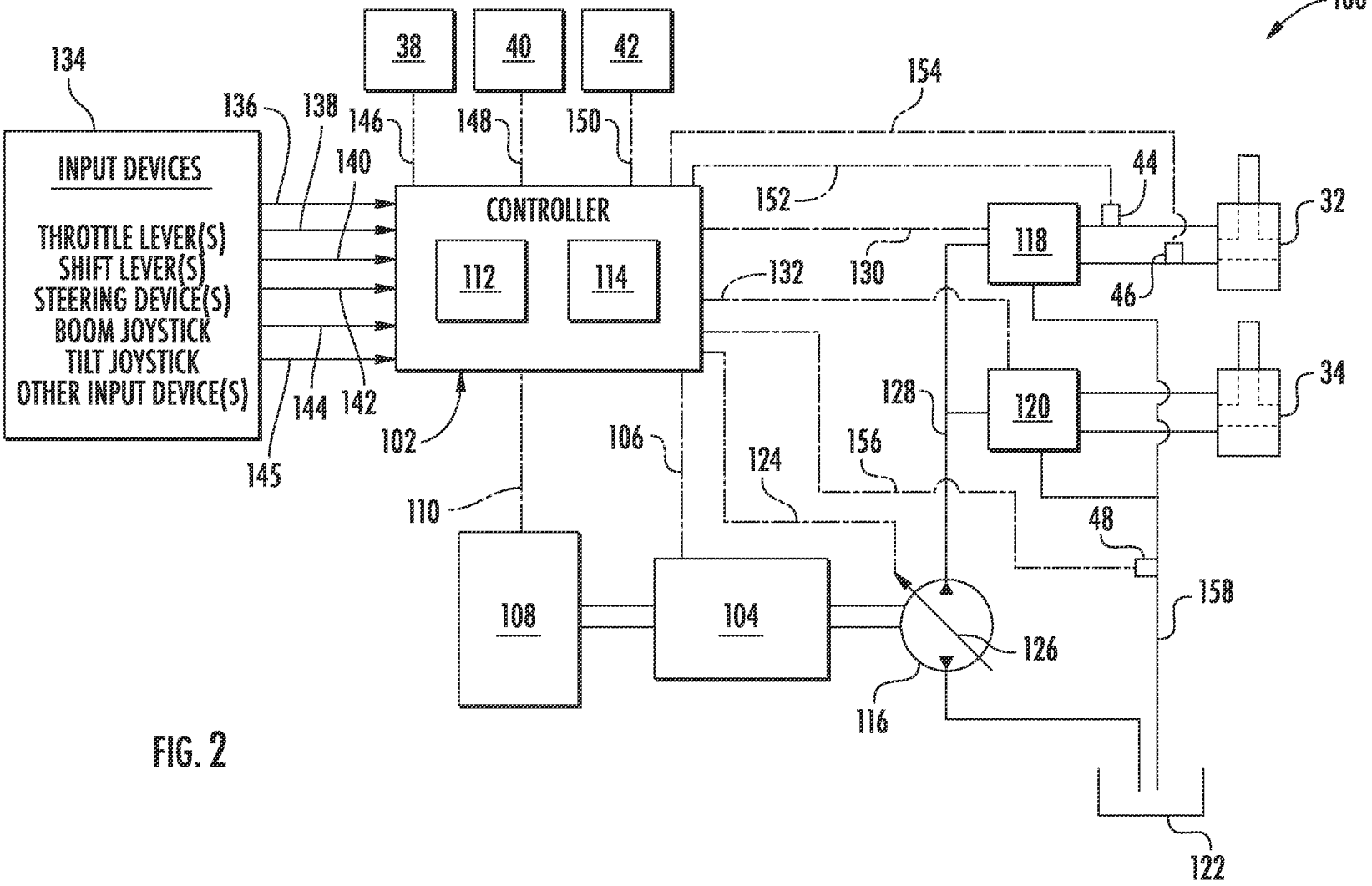
FIG. 2 illustrates a schematic view of one embodiment of a system for operating a work vehicle in accordance with aspects of the present subject matter.

Referring now to FIG. 2, a schematic, simplified view of one embodiment of a system 100 for operating a work vehicle is illustrated in accordance with aspects of the present subject matter. In general, the system 100 will be described herein with reference to the work vehicle 10 shown in FIG. 1. However, it should be appreciated that the disclosed system 100 may be utilized with any other suitable work vehicles. It should be appreciated that hydraulic or fluid couplings of the system 100 shown in FIG. 2 are indicated by solid lines. Similarly, communicative links or electrical couplings of the system 100 shown in FIG. 2 are indicated by phantom lines.

As shown in FIG. 2, in several embodiments, the system 100 may include a controller 102 configured to control the operation of one or more components of the work vehicle 10, such as one or more components of the vehicle's drivetrain and/or the vehicle's lift assembly 20. For example, the controller 102 may be communicatively coupled to one or more components of an engine 104 of the work vehicle 10 (e.g., an engine governor or engine control unit (ECU) (not shown)) via one or more communicative links 106 in order to control and/or monitor the speed and/or torque output of the engine 104. Similarly, the controller 102 may be communicatively coupled to one or more components of a transmission 108 of the work vehicle 10 via one or more communicative links 110 to control the operation of the transmission 108. For instance, the controller 102 may be configured to transmit suitable control commands via communicative link 110 to one or more clutch valves (not shown) to control the engagement/disengagement of one or more clutches (not shown) of the transmission 108.

It should be appreciated the controller 102 may generally comprise any suitable processor-based device known in the art, such as one or more computing devices. Thus, in several embodiments, the controller 102 may include one or more processor(s) 112 and associated memory device(s) 114 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory 114 of the controller 102 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory 114 may generally be configured to store suitable computer-readable instructions that, when implemented by the processor(s) 112, configure the controller 102 to perform various computer-implemented functions, such as performing the various calculations, algorithms, and/or methods described herein. In addition, the controller 102 may also include various other suitable components, such as a communications circuit or module, one or more input/output channels, a data/control bus and/or the like.

It should also be appreciated that the controller 102 may correspond to an existing controller of the work vehicle 10 (e.g., an existing engine and/or transmission controller or other vehicle controller) or the controller 102 may correspond to a separate controller. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

Moreover, the controller 102 may also be communicatively coupled to one or more components for controlling the operation of the various actuators 32, 34 of the lift assembly 20 of the work vehicle 10. For example, in several embodiments, the controller 102 may be coupled to one or more pumps 116 and associated control valves 118, 120 for controlling the flow of hydraulic fluid from a fluid tank 122 of the work vehicle 10 to each actuator 32, 34. Specifically, as shown in FIG. 2, the lift assembly 20 may include a hydraulic pump 116 driven via an output of the engine 104. In such an embodiment, the controller 102 may be communicatively coupled to the hydraulic pump 116 (e.g., via communicative link 124) so that the position or angle of a swash plate of the first hydraulic pump 116 (the swash plate being denoted by diagonal arrow 126 through the pump 116) may be automatically adjusted to regulate the discharge pressure of the pump 116. In one embodiment, the angle of the swash plate 126 may be adjusted via an associated actuator(s) (not shown) configured to be controlled by the controller 102.

As shown in FIG. 2, the hydraulic pump 116 may be fluidly coupled to one or more boom control valves 118 and one or more tilt control valves 120 via one or more fluid lines 128. The boom control valve(s) 118 may generally be configured to regulate the supply of hydraulic fluid to the boom actuator(s) 32, thereby controlling the extension/retraction of the boom actuator(s) 32. Similarly, the tilt control valve(s) 120 may generally be configured to regulate the supply of hydraulic fluid to the tilt actuator(s) 34, thereby controlling the extension/retraction of the tilt actuator(s) 34. In several embodiments, the control valves 118, 120 may correspond to electrically controlled valves (e.g., solenoid-activated valves) to allow the controller 102 to automatically control the operation of each valve 118, 120. For instance, as shown in FIG. 2, the controller 102 may be communicatively coupled to the control valves 118, 120 via associated communicative links 130, 132, thereby allowing the controller 102 to regulate the extension/retraction of the associated actuators 32, 34 via control of the valves 118, 120.

The controller 102 may also be communicatively coupled to one or more operator-controlled input devices 134 located within the vehicle's cab 18. As such, the controller 102 may be configured to receive various operator-initiated control commands for controlling the operation of the work vehicle 10. For instance, the controller 102 may be communicatively coupled to an engine throttle lever to allow the controller 102 to receive control signals associated with operator-initiated engine speed commands for adjusting the engine speed of the engine 104 (e.g., as indicated by arrow 136 in FIG. 2). In addition, the controller 102 may be communicatively coupled to a shift lever or other suitable input device configured to allow the operator to transmit control signals associated with operator-initiated shift commands for adjusting the current gear ratio of the transmission 108 (e.g., as indicated by arrow 138 in FIG. 2). Similarly, the controller 102 may be communicatively coupled to a steering sensor configured to allow the controller 102 to receive steering commands (e.g., as indicated by arrow 140 in FIG. 2) associated with adjustments in the vehicle's steering angle as the operator manipulates the steering wheel or other steering device of the work vehicle 10. Moreover, the controller 102 may be communicatively coupled to one or more joysticks for receiving control commands associated with controlling the movement of the boom 32 and/or the implement 34. For instance, the controller may be coupled to both a boom joystick for receiving operator-initiated control commands associated with controlling the movement of the boom 24 (e.g., as indicated by arrow 142 in FIG. 2) and a tilt joystick for receiving operator-initiated control commands associated with controlling the movement of the implement 22 (e.g., as indicated by arrow 144 in FIG. 2).

As indicated above, the controller 102 may also be communicatively coupled to one or more position sensors 38, 40 (e.g., via communicative links 146, 148) for monitoring the position(s) and/or orientation(s) of the boom 24 and/or the implement 22. In several embodiments, the position sensor(s) 38, 40 may correspond to one or more angle sensors (e.g., a rotary or shaft encoder(s) or any other suitable angle transducer(s)) configured to monitor the angle or orientation of the boom 24 and/or implement 22 relative to one or more reference points. For instance, in one embodiment, a first angle sensor(s) may be positioned at the rear pivot point for the boom 24 to allow the angular position of the boom 24 relative to the work vehicle 10 to be monitored. Similarly, in one embodiment, a second angle sensor(s) may be positioned at one of the pivot points for the bellcrank 36 to allow the position of the implement 22 relative to the boom 24 to be monitored. In alternative embodiments, the position sensors 38, 40 may correspond to any other suitable sensor(s) that is configured to provide a measurement signal associated with the position and/or orientation of the boom 24 and/or the implement 22, such as one or more inclinometers, inertial measurement units, cylinder length sensors, and/or the like. It should be appreciated that the position sensors 38, 40 may also allow the movement velocity of the boom 24 and/or the implement 22 to be determined by identifying the change in position of such component(s) over time.

Moreover, as indicated above, the controller 102 may also be communicatively coupled to one or more inclination sensors 42 (e.g., via communicative link 150) configured to monitor the angle of inclination of the work vehicle 10. For example, in several embodiments, the inclination sensor(s) 42 may comprise one or more one or more accelerometers, inclinometers, gyroscopes and/or any other suitable inclination sensor(s) configured to monitor the angle of inclination of the work vehicle 10 by measuring its orientation relative to gravity. For instance, as described above with reference to FIG. 1, the inclination sensor(s) 42 may correspond to a dual-axis sensor mounted to a portion of the chassis 16 to allow the sensor(s) 42 to monitor the angle of inclination of the work vehicle 10 in two directions (e.g., the pitch and roll directions of the work vehicle 10). However, in other embodiments, the inclination sensor(s) 42 may be disposed on the work vehicle 10 at any other suitable location.

Additionally, in several embodiments, the system 100 may also include one or more pressure sensors 44, 46 communicatively coupled to the controller 102 (e.g., via communicative links 152, 154) to allow the controller 102 to monitor the fluid pressure of the hydraulic fluid being supplied to the boom actuator(s) 32 and/or the tilt actuator(s) 34. For instance, as shown in FIG. 2, the controller 102 may be coupled to first and second pressure sensors 44, 46 provided in fluid communication with the fluid lines provided between the boom control valve(s) 118 and the boom actuator(s) 32, with the first pressure sensor 44 being configured to monitor the fluid pressure of the hydraulic fluid supplied to the rod-side of the boom actuator(s) 32 and the second pressure sensor being configured to monitor the fluid pressure of the hydraulic fluid supplied to the piston-side of the boom actuator(s) 32. Although not shown, it should be appreciated that similar pressure sensors may also be provided in fluid communication with the fluid lines associated with the tilt actuator(s) 34 to monitor the fluid pressure of the hydraulic fluid being supplied to such actuator(s) 34.

Referring still to FIG. 2, the controller 102 may also be communicatively coupled to one or more temperature sensors 48 (e.g., via communicative link 156) configured to allow the temperature of the hydraulic fluid utilized within the vehicle's hydraulic system to be monitored. For instance, as shown in FIG. 2, the temperature sensor(s) 48 may, in one embodiment, be provided in operative association with a return line 158 for the hydraulic fluid to allow the fluid temperature of the hydraulic fluid returned to the fluid tank 122 to be monitored.

It should be appreciated that the controller 102 may also be communicatively coupled to any other suitable sensors configured to monitor one or more operating parameters of the work vehicle 10 and/or its components. For instance, the controller 102 may also be communicatively coupled to a suitable sensor(s) (not shown) that allows the controller 102 to monitor the speed and/or acceleration of the work vehicle 10.

In several embodiments, the controller 102 may be configured to calculate or estimate a current load weight being carried by the vehicle's implement 22. Specifically, in several embodiments, the controller 102 may include known mathematical relationships and/or look-up tables stored within its memory 114 that correlate the vehicle's boom geometry and various relevant operating parameters (e.g., the angular position of the boom 24, the angular position of the implement 22, the velocity of the boom 24 and/or the implement 22, the angle of inclination of the work vehicle 10, the boom actuator pressure(s), the temperature of the hydraulic fluid, and the speed and/or acceleration of the work vehicle 10) to an associated load weight of the implement 22. Thus, by continuously monitoring the relevant operating parameters using the various sensors described above (e.g., the position sensors 38, 40, the inclination sensors 42, the pressure sensors 44, 46, the temperature sensors 48, and the like), the controller 102 may calculate a current load weight for the implement 22 based on such load-related data. This estimated load weight may then, for example, be displayed to the operator of the work vehicle 10 via a suitable display device housed within the cab 18. As will be described below, the estimated load weight may also be used for providing load-dependent machine aggressiveness when executing or implementing one or more functions of the work vehicle 10.

It should be appreciated that, in other embodiments, the controller 102 may be configured to calculate or estimate the current load weight being carried by the vehicle's implement 22 using any other suitable load estimation or monitoring system (e.g., any other suitable payload monitoring system). For instance, in other embodiments, a different combination of sensors or sensing devices may be used to provide the controller 102 with the load-related data, which may then be used to calculate or estimate the current load weight.

Additionally, in accordance with aspects of the present subject matter, the controller 102 may be configured to allow one or more load-dependent control mappings or correlations to be applied in association with one or more of the vehicle's functions. Specifically, in several embodiments, the controller may be configured to adjust the input/output control mapping for one or more vehicle functions based on the current load weight being carried by the implement 22, with the control mapping generally being used to correlate operator inputs received from an associated input device (e.g., input device(s) 134) to the output commands used to control the associated component(s) for executing the desired vehicle function. For instance, as will be described below, the controller 102 may be configured to adjust the correlation provided by the applicable input/output control mapping such that a more aggressive mapping is applied when the current load weight is relatively low (i.e., such that the controlled component(s) is more responsive to operator input commands) and a less aggressive control mapping is applied when the current load weight is relatively high (i.e., such that the controlled component(s) is less responsive to operator input commands). By "more aggressive" or "more responsive", it is generally meant that the controlled vehicle function will be more sensitive to input commands provided by the operator (e.g., such that a smaller range of movement of a joystick, lever, or other suitable input device will be required to cause an associated actuator(s) or other component that is being controlled by the input device to be actuated/adjusted across a defined range and/or at a defined speed/acceleration). Similarly, by "less aggressive" or "less responsive", it is generally meant that the controlled vehicle function will be less sensitive to input commands provided by the operator (e.g., such that a larger range of movement of a joystick, lever, or other suitable input device will be required to cause an associated actuator(s) or other component that is being controlled by the input device to be actuated/adjusted across the defined range and/or at the defined speed/acceleration).

It should be appreciated that the load-dependent input/output control mapping or correlation described herein may be applied to various different control functions. For instance, in one embodiment, the load-dependent control mapping may be applied to the boom movement function such that the mapping between the inputs received from the boom joystick (or other suitable input device) and the control commands transmitted by the controller 102 to control the operation of the boom actuator(s) 32 may be varied as a function of the implement load weight. In another embodiment, the load-dependent control mapping may be applied to the implement tilt function such that the control mapping between the inputs received from the tilt joystick (or other suitable input device) and the control commands transmitted by the controller 102 to control the operation of the tilt actuator(s) 34 may be varied as a function of the implement load weight. In a further embodiment, the load-dependent control mapping may be applied to the vehicle drive function such that the control mapping between the inputs received from any drive-related input devices (e.g., the engine throttle lever, the shift lever, etc.) and the control commands transmitted by the controller to control the operation of any related drive components (e.g., the engine, transmission, etc.) may be varied as a function of the implement load weight. In yet another embodiment, the load-dependent control mapping may be applied to the vehicle steering function such that the control mapping between the inputs received from the steering wheel or other steering-related device and the control commands transmitted by the controller 102 to control the operation of the vehicle's steering actuator(s) may be varied as a function of the implement load weight.

Additionally, it should be appreciated that load-dependent control mapping may be applied to a single vehicle function or to a combination of vehicle functions. For instance, in one embodiment, load-dependent control mapping may only be applied to the boom movement function. In another embodiment, load-dependent control mapping may be applied to both the boom movement function and the implement tilt function. In a further embodiment, load-dependent control mapping may be applied to the boom movement function and one or more of the implement tilt function, the vehicle drive function, and/or the vehicle steering function. In other embodiments, load-dependent control mapping may be applied to any other single vehicle function or any other suitable combination of vehicle functions.

It should also be appreciated that, in one embodiment, the load-dependent control mapping may also be partially applied to a given vehicle function. For instance, as an example, the current load weight being carried by the implement 22 will generally impact boom movement more when the boom 24 is being lowered as opposed to when it is being raised. Specifically, the boom 24 will typically lower faster in response to a given boom joystick command when there is a heavy load on the boom 24 than when the same joystick command is provided under lower loading conditions. As such, in one embodiment, it may be desirable to provide load-dependent control mapping for the boom lowering function while providing a baseline or typical control mapping for the boom raising function.

Figure 3:
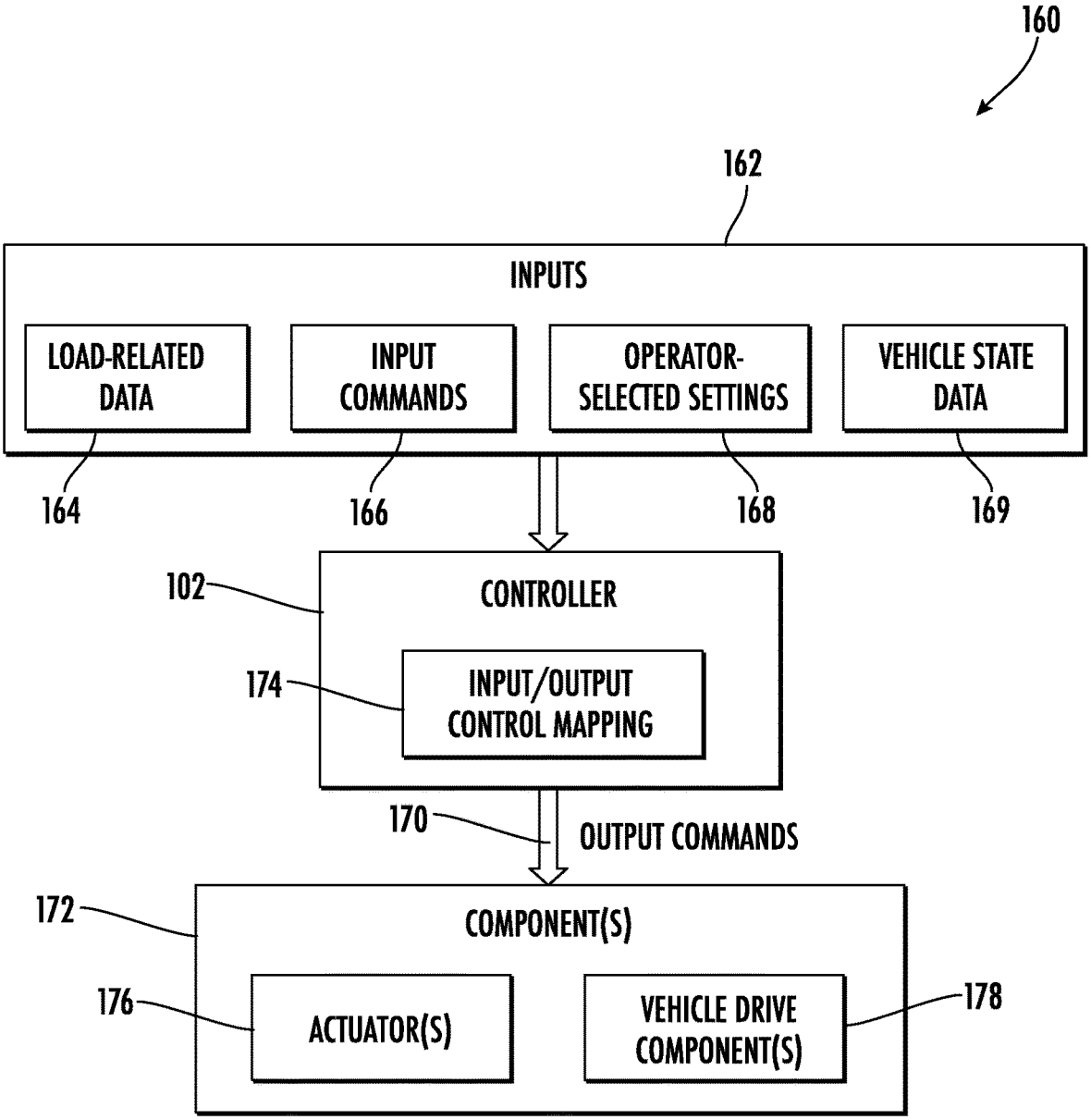
FIG. 3 illustrates a schematic view of one embodiment of a system input/output diagram for implementing load-dependent machine aggressiveness for vehicle functions of a work vehicle in accordance with aspects of the present subject matter.

Referring now to FIG. 3, a schematic view of one embodiment of a system input/output diagram 160 for implementing load-dependent machine aggressiveness for vehicle functions of a work vehicle is illustrated in accordance with aspects of the present subject matter. In general, the input/output diagram 160 will be described herein with reference to the system 100 described above with reference to FIG. 2. However, it should be appreciated that, in other embodiments, the present subject matter may be advantageously applied in association with systems having any other suitable system configuration.

In general, when executing the load-dependent machine aggressiveness functionality described herein, the controller 102 (or any other suitable computing system or controller) may be configured to receive numerous inputs (e.g., inputs 162) from various input devices (e.g., sensors, operator-controlled devices, etc.). For instance, as shown in FIG. 3, the controller 102 may be configured to receive load-related data (indicated by box 164) associated with a load weight currently being carried by the implement 22. As indicated above, such data may, in several embodiments, correspond to sensor data received from various sensors of the work vehicle 10 (e.g., the position sensors 38, 40, the inclination sensors 42, the pressure sensors 44, 46 the temperature sensors 48, and the like) that allow the controller 102 to calculate the current load weight for the implement 22. In other embodiments, the load-related data may be received from any other suitable payload monitoring system that allows for the current load weight of the implement 22 to be monitored.

Additionally, as shown in FIG. 3, the controller 102 may be configured to receive one or more operator-initiated input commands (indicated by box 166) associated with executing one or more vehicle functions of the work vehicle 10. For instance, as indicated above, the controller 102 may be communicatively coupled to various operator-controlled input devices 134 for allowing the operator to provide input commands for executing any number of vehicle functions, such as a boom joystick for providing boom movement commands, a tilt joystick for providing implement tilt commands, an engine throttle lever for providing engine speed commands, a steering wheel or other steering device (e.g., via an associated steering sensor) for providing steering commands, and/or the like.

Moreover, as shown in FIG. 3, the controller 102 may also be configured to receive one or more operator-selected settings (indicated by box 168) associated with the execution or implementation of the load-dependent machine aggressiveness functionality described herein. For instance, the operator may be allowed to provide one or more inputs (e.g., via a corresponding input device 134) associated with an aggressiveness setting to be applied when adjusting the aggressiveness of the input/output control mapping applied between the operator-initiated control commands and the result output commands, such as by allowing the operator to select between a "low" aggressiveness setting, a "medium" aggressiveness setting, and a "high" aggressiveness setting. In such an embodiment, the controller 102 may adjust or select the appropriate input/output control mapping based on the aggressiveness setting select by the operator.

Additionally, in one embodiment, the operator may be allowed to provide one or more inputs (e.g., via a corresponding input device 134) associated with a threshold setting(s) for activating the load-dependent machine aggressiveness functionality described herein and/or for adjusting/switching the input/output control mapping being used to correlate input/output commands for the desired vehicle function. For instance, the operator may select a given load threshold below which the controller 102 is configured to apply a baseline input/output control mapping for the associated vehicle function that exhibits a baseline aggressiveness or responsiveness and above which the controller 102 is configured to apply a modified or adjusted input/output control mapping for the associated vehicle function that exhibits a reduced aggressiveness or responsiveness relative to the baseline aggressiveness/responsiveness. Similarly, the operator may select one or more load thresholds at which the input/output control mapping being applied is switched or transitioned to a new input/output control mapping (e.g., a less aggressive input/output control mapping).

It should be appreciated that the operator may also be allowed to provide various other inputs associated with the selection of applicable settings and/or associated with the execution or implementation of the load-dependent machine aggressiveness functionality described herein. For instance, the operator may be allowed to disable or enable the load-dependent machine aggressiveness functionality, as desired. In addition, the operator may be allowed to select which vehicle function(s) that the load-dependent machine aggressiveness functionality will be applied, such as by allowing the operator to select one or more of the boom movement function, the implement tilt function, the vehicle drive function, the vehicle steering function, etc.

Additionally, as shown in FIG. 3, the controller 102 may also be configured to receive vehicle state data (indicated by box 169) that can be used as additional contextual information when implementing the load-dependent machine aggressiveness functionality described herein. In general, vehicle state data may refer to any data associated with a given state and/or condition of the work vehicle 10, including, but not limited to, the current position of the boom 24, the current angle of inclination or orientation of the work vehicle 10, the current engine speed of the engine 104, and/or various other types of vehicle-related state/condition data. Such data may, in certain instances, be used to determine when to activate the load-dependent machine aggressiveness functionality and/or when to adjust/switch the input/output control mapping being used to correlate input/output commands for the desired vehicle function. For instance, there may be kinematic positions for the boom 24 that are more sensitive to loads than other positions, such as when the boom 24 is at its maximum height and/or extended fully outwardly. Similarly, there may be certain inclination angles for the vehicle that are more sensitive to loads than other inclination angles, such as when the vehicle is at or close to a tipping angle in either the roll or pitch direction. In such instances, by monitoring the current boom position (e.g., via the position sensor(s) 38) and/or the current inclination angle (e.g., via the inclination sensor(s) 42), the machine aggressiveness may be varied or adjusted, as necessary, to ensure safe and effective machine operation. Similarly, in certain instances, the responsiveness of the work vehicle 10 may generally vary with respect to the engine speed, such as by being more responsive at higher engine speeds and less responsive at lower engine speeds. In such instances, the engine speed may be considered in determining when (and to what extent, if any) the machine aggressiveness should be adjusted.

Based on the various inputs received by the controller 102 (e.g., the load-related data 164 and the operator-initiated input commands 166) and, optionally, any vehicle state date 169 and/or applicable settings 168 associated with the execution or implementation of the load-dependent machine aggressiveness functionality (e.g., any predetermined settings stored within the memory of the controller 102, such as an operator-selected aggressiveness setting(s) and/or load threshold setting(s)), the controller 102 may be configured to calculate or determine an appropriate output command (indicated by arrow 170) to control the operation of the component(s) (indicated generically by box 172) responsible for executing the vehicle function being commanded by the operator. For instance, based on the current load weight of the implement 22 (and, optionally, any applicable settings and/or relevant vehicle state data), the controller 102 may be configured to identify an input/output control mapping or correlation (indicated by box 174) for use in executing the vehicle function being commanded by the operator, such as by selecting an input/output control mapping from a plurality of different load-specific input/output control mappings stored within the controller's memory or by calculating a load-dependent input/output control mapping as a function of the monitored load. Thereafter, the identified input/output control mapping may be used to correlate the operator-initiated input command 166 received by the controller to a corresponding output command 170 for controlling the operation of the corresponding component(s) 172 of the work vehicle (e.g., one or more actuators 176, such as the lift actuator(s), tilt actuator(s), steering actuator(s), etc., and/or one or more vehicle drive components 178 (e.g., the engine, transmission, etc.). For example, if the operator is commanding boom movement or implement tilting, the input command(s) received from the operator may be correlated to a corresponding load-dependent output command for controlling the operation of the boom actuator(s) 32 or the tilt actuator(s) 34, respectively. Similarly, if the operator is commanding that the work vehicle 10 be steered, the input command(s) received from the operator may be correlated to a corresponding load-dependent output command for controlling the operation of the steering actuator(s). Additionally, if the operator is commanding vehicle motion, the input command(s) received from the operator may be correlated to a corresponding load-dependent output command for controlling the operation of one or more vehicle drive components 178, such as the engine and/or transmission.

It should be appreciated that the input/output control mapping 174 applied by the controller 102 may define one or more parameters associated with the correlation between the operator-initiated input command 166 and the resulting output command 170. For instance, in one embodiment, the input/output control mapping 174 may define the speed at which the component(s) 172 can be actuated or adjusted, such as by controlling the speed at which one or more of the actuators 176 can be extended or retracted or by controlling the speed at which the vehicle drive component(s) 178 can be adjusted (e.g., the speed at which the engine RPMs can be ramped up or down). Additionally, the input/output control mapping may define the rate of change at which the speed of the component(s) 172 can be actuated or adjusted, such as by controlling the acceleration of the extension or actuation of one or more of the actuators 176.

Additionally, it should be appreciated that, in embodiments in which the controller 102 is configured to adjust or modify the input-output control mapping for a given vehicle function based on the implement load weight, such adjustments may be made using any suitable methodology. As indicated above, in several embodiments, the controller 102 may store within its memory a normal or baseline input/output control mapping for each vehicle function (e.g., in the form of look-up tables) and may be configured to use a "sensitivity modifier" or similar correction value to adjust the baseline input/output control mapping for a given vehicle function when executing the load-dependent machine aggressiveness functionality described herein. For example, the sensitivity modifier may be used to adjust the baseline input/output control mapping such that the sensitivity of the control mapping is reduced with increased implement loads (e.g., by multiplying or dividing the input side and/or output side of the control mapping by the sensitivity modifier or by adding or subtracting the sensitivity modifier to/from the input side and/or output side of the control mapping, as appropriate). In such embodiments, the sensitivity modifier may correspond to a constant value that is applied, for example, when the implement load exceeds a given load threshold (or across the entire load range) or the sensitivity modifier may correspond to a value that is varied as a function of the load.

Figure 4:
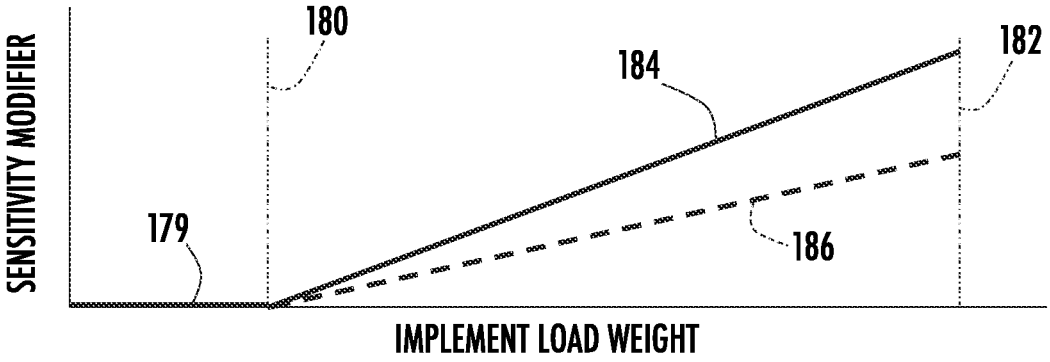
FIG. 4 illustrates an example plot that graphs implement load weight relative to a sensitivity modifier used for adjusting an input/output control mapping in accordance with aspects of the present subject matter.

For instance, FIG. 4 illustrates a graph showing one embodiment of an exemplary relationship that can be defined between the sensitivity modifier and the implement load weight to allow the normal or baseline input/output control mapping for a given vehicle function to be modified based on the monitored load weight. As shown in FIG. 4, the sensitivity modifier may be equal to a baseline value (as indicated by line 179, e.g., a value of "1" if the modifier is being used as a multiplier or divider for the control mapping or a value of "0" if the modifier is being used as an adder or subtractor for the control mapping) when the monitored load weight is less than a given load threshold (e.g., an operator-selected load threshold setting as indicated by dashed line 180) such that the baseline input/output control mapping is applied at load weights below the load threshold 180. However, when the implement load weight exceeds the load threshold 180, the sensitivity factor may be varied as a function of the load weight to allow for the baseline input/output control mapping to be modified in a manner that reduces the sensitivity of the associated control mapping (e.g., assuming in the illustrated embodiment that a higher sensitivity modifier results in a less aggressive, less sensitive control mapping). For instance, in the illustrated embodiment, the sensitivity factor is varied as a function of the load weight according to a linear relationship (e.g., as indicated by lines 184, 186) such that the sensitivity modifier is continuously increased with increases in the load weight between the load threshold 180 and a maximum load threshold for the work vehicle 10 (e.g., as indicated by dashed line 182). It should be appreciated that, as an alternative to varying the sensitivity modifier as a function of the load weight according to a linear relationship, the sensitivity modifier may, instead, be varied in accordance with a non-linear relationship defined between the sensitivity modifier and the load weight.

Additionally, as indicated above, an operator of the work vehicle 10 may be allowed to select an aggressiveness setting that, in one embodiment, varies the extent to which the baseline input/output control mapping will be modified as a function of the implement load weight. For instance, in the embodiment shown in FIG. 4, one of two different modifier/load relationships may be used depending on the selected aggressiveness setting. Specifically, assuming higher values for the sensitivity modifier result in a less aggressive, less sensitive control mapping, the modifier/load relationship indicated by solid line 184 may be used when the operator selects a low aggressiveness setting while the modifier/load relationship indicated by dashed line 186 may be used when the operator selects a high aggressiveness setting, thereby allowing the sensitivity modifier to be increased more significantly with increasing loads when applying the low aggressiveness setting as opposed to the high aggressiveness setting. As a result, while both settings provide a less sensitive control mapping than the baseline input/output control mapping at implement loads above the load threshold 180, the operator is provided some flexibility in deciding the extent to which the sensitivity is reduced at increased implement loads.

Figure 5:
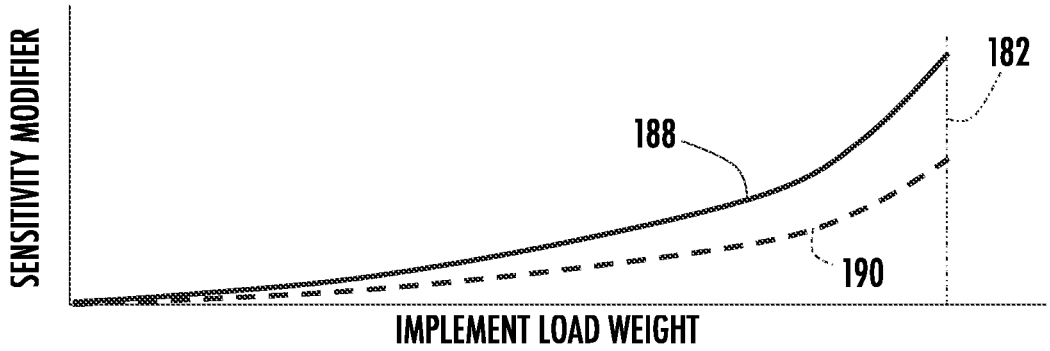
FIG. 5 illustrates another example plot that graphs implement load weight relative to a sensitivity modifier used for adjusting an input/output control mapping in accordance with aspects of the present subject matter.

Another exemplary relationship that can be defined between the sensitivity modifier and the implement load weight is illustrated in FIG. 5. As shown, unlike the example provided above with reference to FIG. 4, the sensitivity modifier is varied across the entire load range for the implement (e.g., from a zero load indicated at the origin to the max load threshold indicated by line 182). Additionally, unlike the example described above, the sensitivity factor is varied as a function of the load weight according to a non-linear relationship (e.g., as indicated by lines 188, 190). Specifically, in the illustrated embodiment, the rate of change of the sensitivity modifier increases with increasing load weights such that higher load weights result in greater reductions in the sensitivity of the input/output control mapping (e.g., assuming in the illustrated embodiment that a higher sensitivity modifier results in a less aggressive, less sensitive control mapping). As shown in FIG. 5, similar to the embodiment described above, different modifier/load relationships may be used depending on an aggressiveness setting selected by the operator, such as by using the modifier/load relationship indicated by solid line 188 when the operator selects a low aggressiveness setting and the modifier/load relationship indicated by dashed line 190 when the operator selects a high aggressiveness setting.

Figure 6:
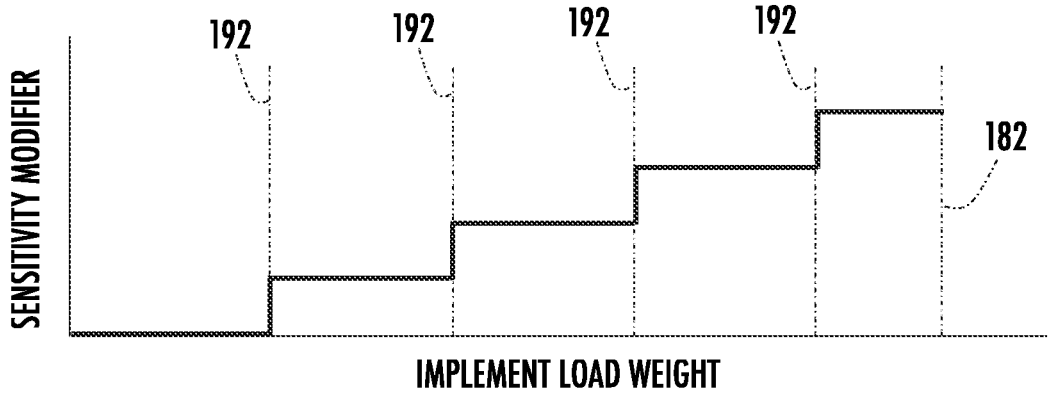
FIG. 6 illustrates yet another example plot that graphs implement load weight relative to a sensitivity modifier used for adjusting an input/output control mapping in accordance with aspects of the present subject matter.

Yet another exemplary relationship that can be defined between the sensitivity modifier and the implement load weight is illustrated in FIG. 6. As shown in FIG. 6, the sensitivity modifier is varied according to a tiered or stepped relationship across the load range for the implement (e.g., from a zero load indicated at the origin to the max load threshold indicated by line 182). Specifically, in the illustrated embodiment, a series of intermediate load thresholds are defined across the load range (e.g., as indicated by dashed lines 192) at which the sensitivity modifier is increased by a given amount. Such stepwise increases may allow the sensitivity of the control mapping to be incrementally reduced with increases in the implement load. In one embodiment, the various load thresholds 192 may be operator-selected (e.g., operator-selected threshold settings) or such thresholds 192 may correspond to manufacturer-defined thresholds.

It should be appreciated that the above-described relationships shown in FIGS. 3-5 are merely illustrated to provide examples of correlations that can be defined between the implement load weight and an associated "sensitivity modifier" or any other load-dependent correction value. In other embodiments, any other suitable relationship or correlation may be used.

Figure 7:
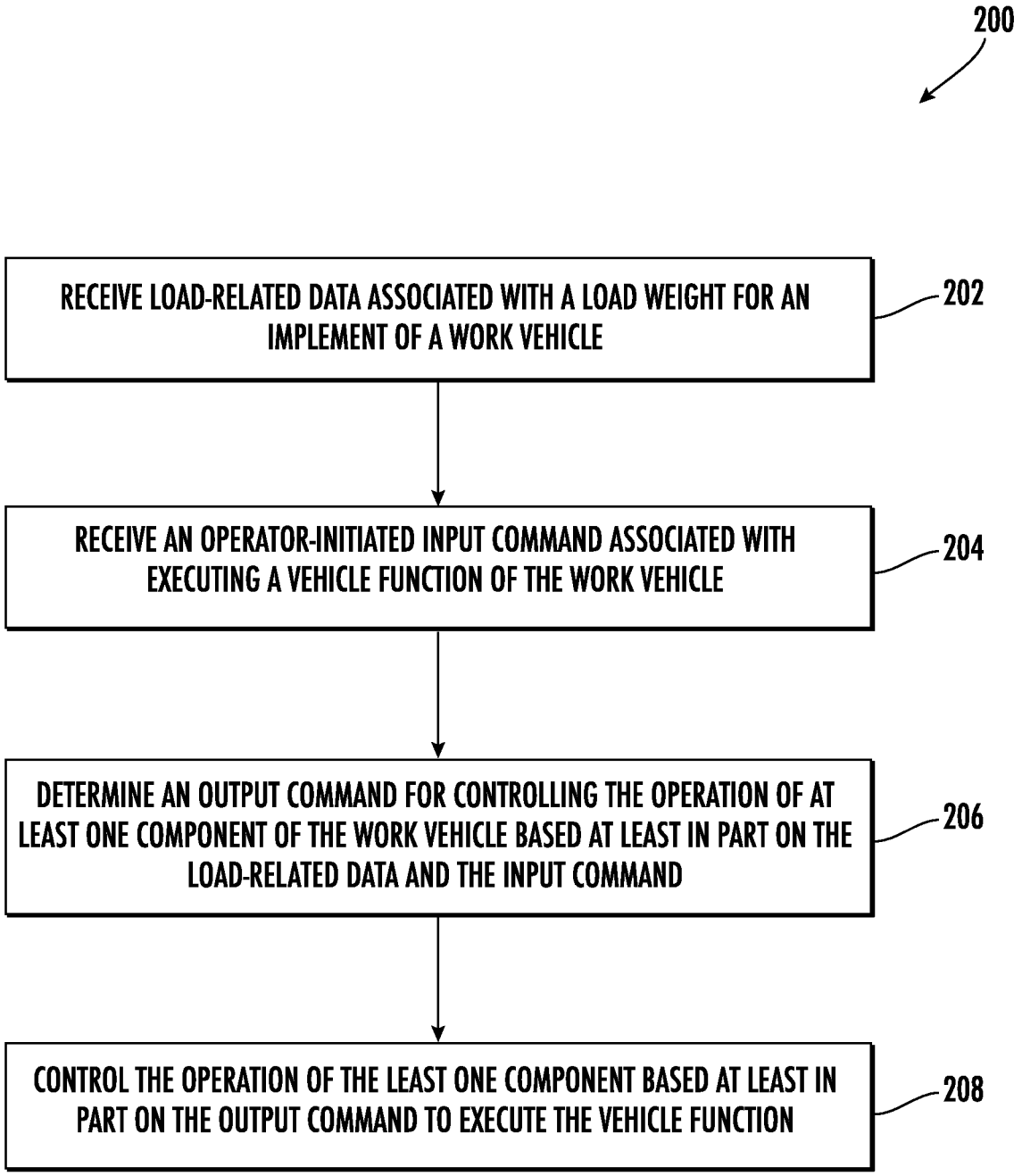
FIG. 7 illustrates a flow diagram of one embodiment of a method for implementing load-dependent machine aggressiveness for vehicle functions of a work vehicle in accordance with aspects of the present subject matter.

Referring now to FIG. 7, a flow diagram of one embodiment of a method 200 for implementing load-dependent machine aggressiveness for vehicle functions of a work vehicle is illustrated in accordance with aspects of the present subject matter. In general, the method 200 will be described herein with reference to the work vehicle 10 shown in FIG. 1, as well as the various system components/functionality shown in FIGS. 2 and 3. However, it should be appreciated that the disclosed method 200 may be implemented with work vehicles having any other suitable configuration and/or within systems having any other suitable system configuration. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 7, at (202), the method 200 may include receiving load-related data associated with a load weight for an implement of a work vehicle. For instance, as indicated above, the controller 102 may be configured to receive load-related data (e.g., from one or more sensors, such as the position sensors 38, 40, the inclination sensors 42, the pressure sensors 44, 46, the temperature sensors 48, and the like) that allows the controller 102 to calculate the current load weight for the implement 22.

In addition, at (204), the method 200 may include receiving an operator-initiated input command associated with executing a vehicle function of the work vehicle. For instance, as indicated above, the controller 102 may be configured to receive operator-initiated input commands from one or more input devices 134 that are associated with commanding the controller 102 to execute one or more vehicle functions, such as a boom movement function, implement tilt function, vehicle steering function, vehicle drive function, and/or the like.

Moreover, at (206), the method 200 may include determining an output command for controlling the operation of at least one component of the work vehicle based at least in part on the load-related data and the input command. For instance, as indicated above, the controller 102 may be configured to utilize a load-dependent input/output control mapping that correlates the input command to a corresponding output command for controlling the operation of one or more components used to execute the desired vehicle function.

Referring still to FIG. 7, at (208), the method 200 may include controlling the operation of the least one component based at least in part on the output command to execute the vehicle function. Specifically, as indicated above, the controller 102 may be configured to control the operation of an associated component, such as one or more actuators or vehicle drive components, to execute the desired vehicle function.

It is to be understood that the steps of the method 20 can be performed by a computing system upon loading and executing software code or instructions which are tangibly stored on a tangible computer readable medium, such as on a magnetic medium, e.g., a computer hard drive, an optical medium, e.g., an optical disc, a solid-state memory, e.g., flash memory, or other storage media known in the art. Thus, any of the functionality performed by any computing system described herein, such as the method 200, is implemented in software code or instructions which are tangibly stored on a tangible computer readable medium. The computing system loads the software code or instructions via a direct interface with the computer readable medium or via a wired and/or wireless network. Upon loading and executing such software code or instructions by the computing system, the computing system may perform any of the functionality of the computing system described herein, including any steps of the method 200 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for implementing load-dependent machine aggressiveness for vehicle functions of a work vehicle, the method comprising:

receiving, with one or more computing devices, load-related data associated with a load weight for an implement of the work vehicle, the implement being coupled to a boom of the work vehicle;

receiving, with the one or more computing devices, an operator-initiated input command associated with executing a vehicle function of the work vehicle;

referencing, with the one or more computing devices, one or more settings associated with a correlation defined between the input command and an output command for controlling the operation of at least one component of the work vehicle;

determining, with the one or more computing devices, the output command based at least in part on the load-related data, the input command, and the one or more settings; and controlling, with the one or more computing devices, the operation of the least one component based at least in part on the output command to execute the vehicle function, wherein the one or more settings comprise an aggressiveness setting associated with the correlation defined between the input command and the output command.

2. The method of claim 1, wherein the one or more settings further comprise a load threshold setting at which the correlation between the input command and the output command is varied.

3. The method of claim 1, wherein determining the output command comprises:

determining the output command according to a first input/output control mapping that correlates the input command to the output command when the load weight for the implement is less than a predetermined load threshold; and determining the output command according to a second input/output control mapping that correlates the input command to the output command when the load weight for the implement is greater than the predetermined load threshold, the second input/output control mapping differing from the first input/output control mapping.

4. The method of claim 3, wherein the second input/output control mapping provides a less aggressive correlation between the input command and the output command than the first input/output control mapping.

5. The method of claim 1, further comprising determining an input/output control mapping that correlates the input command to the output command based at least in part on the load-related data, wherein determining the output command comprises determining the output command based on the input command and the input/output control mapping.

6. The method of claim 1, wherein the vehicle function comprises a boom movement function associated with at least one of lowering or raising the boom, and wherein controlling the operation of the at least one component comprises controlling the operation of a boom actuator of the work vehicle based at least in part on the output command.

7. The method of claim 1, wherein the vehicle function comprises an implement tilt function associated with tilting the implement, and wherein controlling the operation of the at least one component comprises controlling the operation of a tilt actuator of the work vehicle based at least in part on the output command.

8. The method of claim 1, wherein the vehicle function comprises a vehicle steering function associated with steering the work vehicle, and wherein controlling the operation of the at least one component comprises controlling the operation of a steering actuator of the work vehicle based at least in part on the output command.

9. The method of claim 1, wherein the vehicle function comprises a vehicle drive function associated with moving the work vehicle, and wherein controlling the operation of the at least one component comprises controlling the operation of a drive component of the work vehicle based at least in part on the output command.

10. A system for implementing load-dependent machine aggressiveness for vehicle functions of a work vehicle, the system comprising:

a lift assembly including a boom and an implement coupled to the boom;

at least one sensor configured to generate load-related data associated with a load weight for the implement;

a controller communicatively coupled to the at least one sensor, the controller including a processor and associated memory, the memory storing instructions, that when implemented by the processor, configure the controller to:

receive the load-related data from the at least one sensor;

receive an operator-initiated input command associated with executing a vehicle function of the work vehicle;

reference one or more settings associated with a correlation defined between the input command and an output command for controlling the operation of at least one component of the work vehicle;

determine the output command based at least in part on the load-related data, the input command, and the one or more settings; and control the operation of the least one component based at least in part on the output command to execute the vehicle function, wherein the at least one setting comprises an aggressiveness setting associated with the correlation defined between the input command and the output command.

11. The system of claim 10, wherein the one or more settings further comprise a load threshold setting at which the correlation between the input command and the output command is varied.

12. The system of claim 10, wherein the controller is configured to determine the output command according to a first input/output control mapping that correlates the input command to the output command when the load weight for the implement is less than a predetermined load threshold, and determine the output command according to a second input/output control mapping that correlates the input command to the output command when the load weight for the implement is greater than the predetermined load threshold, the second input/output control mapping differing from the first input/output control mapping.

13. The system of claim 12, wherein the second input/output control mapping provides a less aggressive correlation between the input command and the output command than the first input/output control mapping.

14. The system of claim 10, wherein the controller is further configured to determine an input/output control mapping that correlates the input command to the output command based at least in part on the load-related data, the controller being configured to determine the output command based on the input command and the input/output control mapping.

15. The system of claim 10, wherein the vehicle function comprises at least one of a boom movement function, an implement tilt function, a vehicle steering function, or a vehicle drive function.

16. A method for implementing load-dependent machine aggressiveness for vehicle functions of a work vehicle, the method comprising:

receiving, with one or more computing devices, load-related data associated with a load weight for an implement of the work vehicle, the implement being coupled to a boom of the work vehicle;

receiving, with the one or more computing devices, an operator-initiated input command associated with executing a vehicle function of the work vehicle;

determining, with the one or more computing devices, an output command for controlling the operation of at least one component of the work vehicle based at least in part on the load-related data and the input command, wherein determining the output command comprises:

determining the output command according to a first input/output control mapping that correlates the input command to the output command when the load weight for the implement is less than a predetermined load threshold; and determining the output command according to a second input/output control mapping that correlates the input command to the output command when the load weight for the implement is greater than the predetermined load threshold, the second input/output control mapping differing from the first input/output control mapping; and controlling, with the one or more computing devices, the operation of the least one component based at least in part on the output command to execute the vehicle function, wherein the second input/output control mapping provides a less aggressive correlation between the input command and the output command than the first input/output control mapping.

17. The method of claim 16, wherein at least one the first input/output mapping or the second input/output mapping is determined based on an aggressiveness setting for the work vehicle.

18. The method of claim 16, wherein the vehicle function comprises a boom movement function associated with at least one of lowering or raising the boom, and wherein controlling the operation of the at least one component comprises controlling the operation of a boom actuator of the work vehicle based at least in part on the output command.

19. The method of claim 16, wherein the vehicle function comprises an implement tilt function associated with tilting the implement, and wherein controlling the operation of the at least one component comprises controlling the operation of a tilt actuator of the work vehicle based at least in part on the output command.

20. The method of claim 16, wherein the vehicle function comprises a vehicle steering function associated with steering the work vehicle, and wherein controlling the operation of the at least one component comprises controlling the operation of a steering actuator of the work vehicle based at least in part on the output command.

21. The method of claim 16, wherein the vehicle function comprises a vehicle drive function associated with moving the work vehicle, and wherein controlling the operation of the at least one component comprises controlling the operation of a drive component of the work vehicle based at least in part on the output command.

* * * * *